US006086481A

United States Patent [19]

Li

[11] Patent Number: 6,086,481

[45] Date of Patent: Jul. 11, 2000

[54] CONNECTOR FOR A SWING ASSEMBLY

[76] Inventor: Tzann-Shin Li, P.O. Box 90, Tainan City, Taiwan

[21] Appl. No.: 09/358,447

[22] Filed: Jul. 22, 1999

[51] Int. Cl.[7] ..... A63G 9/00

[52] U.S. Cl. ..... 472/118; 472/125; 403/157

[58] Field of Search ..... 472/118, 119, 472/120, 121, 122, 123, 124, 125; 403/157, 158, 150, 160; 248/214, 227.4, 340, 324

[56] References Cited

U.S. PATENT DOCUMENTS

| | | | |
|---|---|---|---|
| 1,435,984 | 11/1922 | Schake | 472/125 |
| 1,886,904 | 11/1932 | Rice | 472/125 |
| 2,497,372 | 2/1950 | Pricer | 472/125 |
| 3,145,024 | 8/1964 | Grudoski | 472/118 |

*Primary Examiner*—Kien T. Nguyen

[57] ABSTRACT

A connector for a swing fixed on a frame rod and a swing arm of a swing includes a bearing, two protective covers and a connecting member which has a rectangular horizontal hollow portion for the frame rod to extend therein, and two vertical parallel ears extending down from the horizontal portion. The bearing is sandwiched within round portions of the two covers placed between the two ears and pivotally connected with a pivot pin passing through the ears, the round portions of the covers and the bearing. Each cover has a lower rectangular portion extending down from the round portion to fit around and secured with an upper end of a swing arm so that the swing arm may swing together about the covers with the pivot pin. Thus the connectors permit the swing arms to swing smoothly with little friction, thereby lessening wear of the components.

1 Claim, 3 Drawing Sheets

CONNECTOR FOR A SWING ASSEMBLY

BACKGROUND OF THE INVENTION

This invention relates to a connector for a swing assembly, and particularly to one provided with a bearing for connect a swing arm to permit the swing arm to swing smoothly and with little friction, preventing the components from wear and tear, facilitating assembling and disassembling and reducing the dimensions of the components for convenience of packaging storing and transporting.

Conventional swings are generally constituted of a metal frame made by means of a welding process, and have to be welded together in advance and be transported to a site where it is needed, provided it is impossible to to be assembled with welding process at the site. The frame has lateral rods on an upper side, and the lateral rods have respectively a hang ear in an intermediate portion for hanging a connector with which a swing arm is connected to, and a seat combined with the swing arms.

However, the conventional swings have the following disadvantages in practical use.

1. The components are not replaceable because of welding process, resulting in the whole swing becoming useless, if some components become broken.

2. The large dimensions of the whole swing owing to welding process requires much labor and much time in transporting, resulting in high transporting cost.

3. Rings of the connectors connected with the hang ears cannot permit smooth swinging because of separated point contact, and liable to produce vibration in swinging.

4. Mutual friction caused between the connectors and the hang ears in swinging is large, letting swinging not smooth, so these components are apt to wear quickly, with potential danger in use if they are not checked frequently.

5. Its service life may not long owing to high wear percentage of the components, not meeting the economical principle.

SUMMARY OF THE INVENTION

This invention has been devised to offer a connector for a swing convenient to assemble and disassemble, with components that are easy to replace, reducing the dimensions of the components, lessening mutual friction between components, permitting smooth swinging smooth, and resulting in a long service life.

The feature of the invention is a connector to be fixed on frame rods and swing arms of the frame of a swing, having a connecting member, two protective covers and a bearing. The connecting member has a horizontal rectangular hollow portion for receiving a frame rod therein and two vertical parallel ears extending down from the horizontal portion for the bearing sandwiched between the round portions of the two protective covers and with a pivot passing through the two ears, the two round portions and the bearing to let a swing arm fixed in a lower vertical portions of the two protective covers. Then the swing arm may swing with the pivot fitted in the connector.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
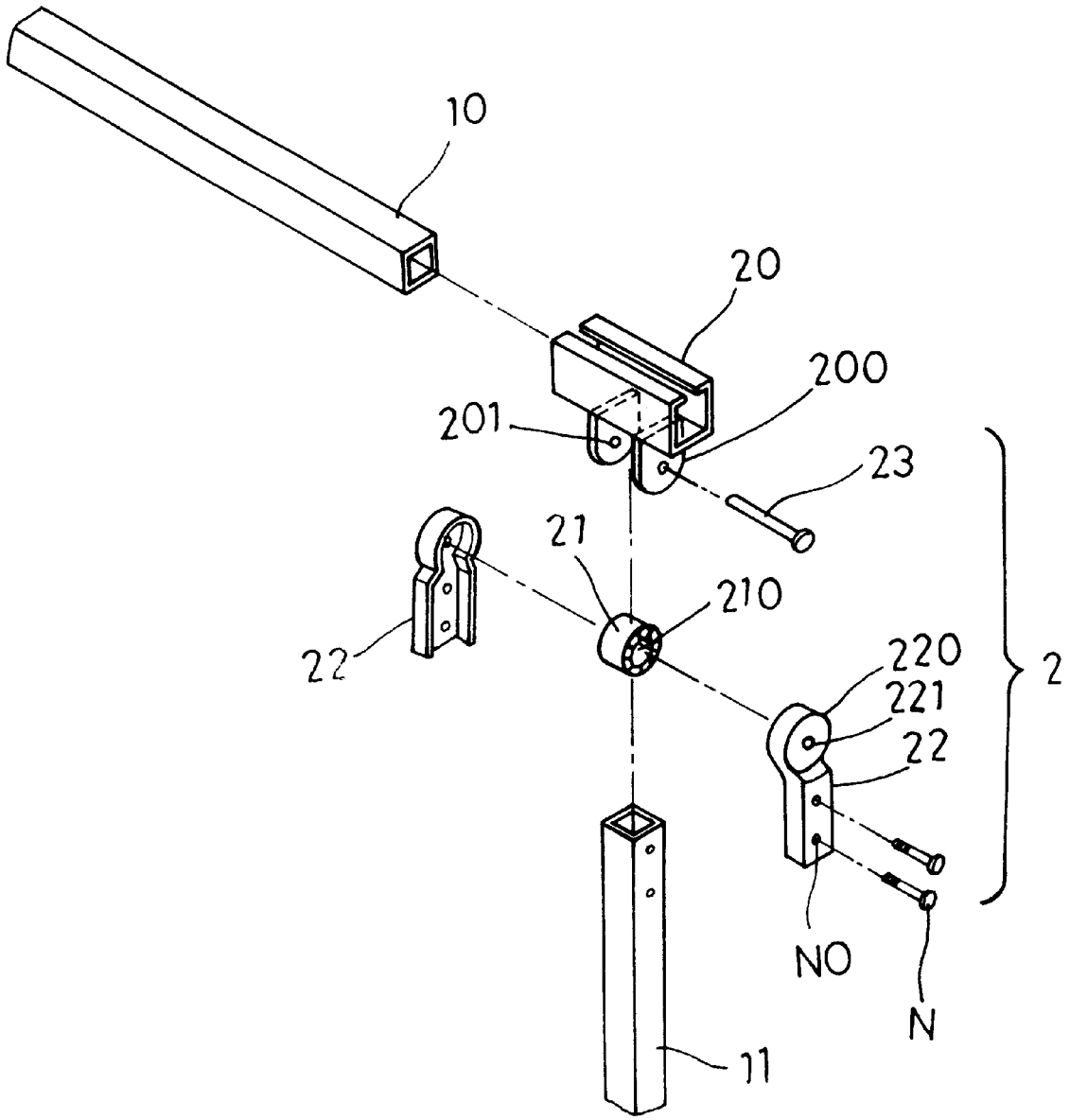
FIG. 1 is an exploded perspective view of a connector for a swing in the present invention.
Figure 2:
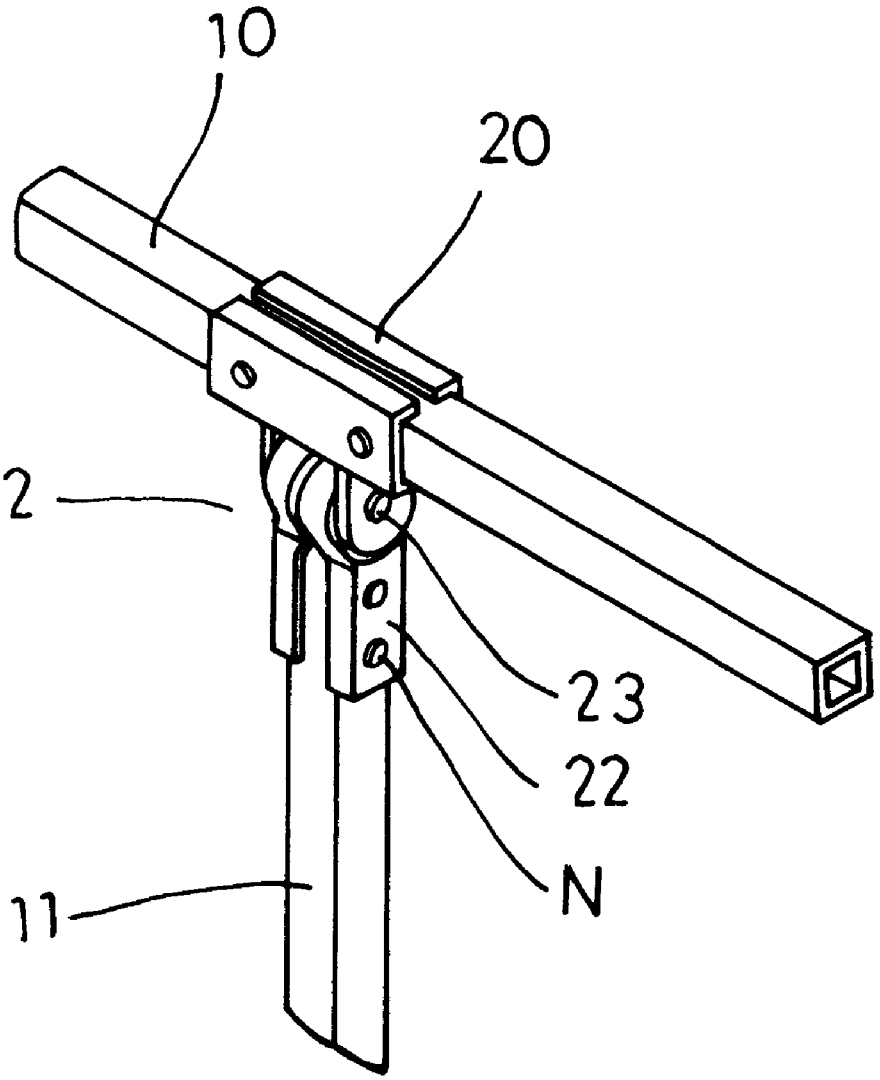
FIG. 2 is a perspective view of the connector in the present invention; and, FIG. 3 is a perspective view of a swing using the connectors in the present invention.
Figure 3:
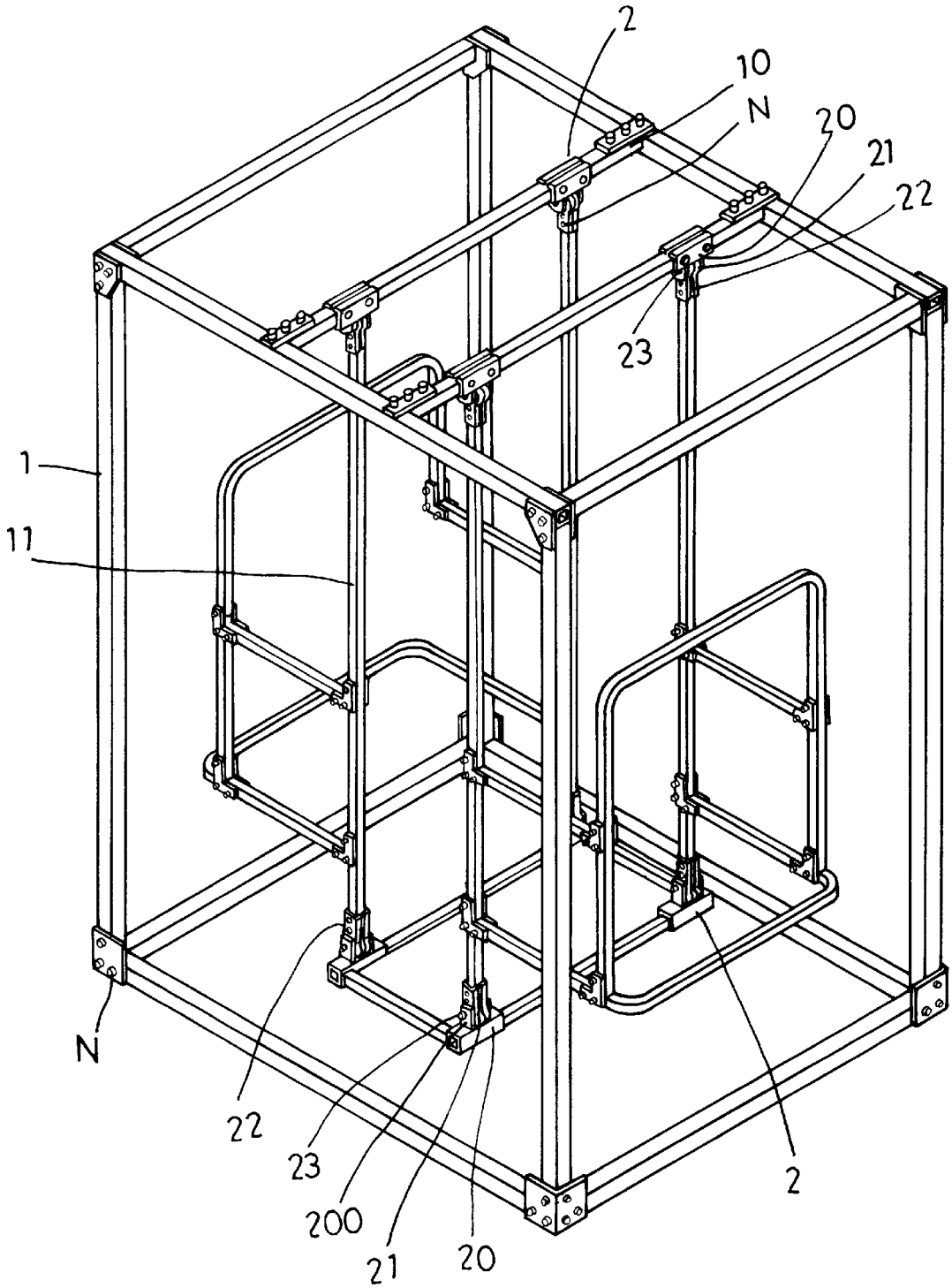

A preferred embodiment of a connector 2 in the present invention, as shown in FIGS. 1, 2 and 3, includes a connecting member 20 connected to a frame rod 10 and a swing arm 11 of a metal frame 1 of a swing.

The connecting member 20 has a horizontal square hollow portion and two vertical parallel flat ears 200 fixed spaced apart under the horizontal portion. The vertical flat ears 200 respectively have a center lateral hole 201. Further, a bearing 21 is provided, having a center shaft hole 210, and two protective covers 22 fitted with each other and having respectively an upper round portion 220 with a center lateral hole 221 and surrounding the bearing 21 and a vertical rectangular portion with two screw holes extending down from the round portion 220. Then the round portions 220 sandwiching the bearing 21 are fitted in the space between two vertical ears 200, with the center holes 201, the center holes 221 and the shaft hole 210 all aligned for a pivot pin 23 to pass through therein to secure the bearing 21 and the two protective covers 22 with the two vertical ears 200, as shown in FIG. 2.

In assembling, firstly, the two protective covers 22 are fitted against each other, sandwiching the bearing 21 in the round portions 220, and then placed in the space between the two vertical ears 200, letting the center holes 221, the center holes 201 and the shaft hole 210 all aligned and the pivot 23 inserted through them to finish assembling of the connector 2. The connecting members 20 of a plurality of the connectors 2 are assembled with the frame rods 10 with their locations adjusted properly and then secured with screws N. Next, the vertical rectangular portions of the two protective covers 22 are fitted around the end of a swing arm 11 or the end of the swing arm 11 is inserted in the space between the two protective covers 22, and secured with screws N. Then the connectors 2 are assembled with the seat of the swing, with the connecting members 20 fitting with lateral rods of the seat, and with the protective covers 22 surrounding the lower ends of the swing arms 11 and secured with screws N, thus finishing assembling the connectors 2 with the frame 1 of the swing, as shown in FIG. 3.

In using, the bearings 21 and the pivot pin 23 of the connectors 2 enable smooth swinging action of the swing arms 11, with much less mutual friction between the connectors and the swing arms 11, and with the components wearing much less than conventional devices of this type.

As can be realized from the aforesaid description, the connector for a swing in the invention has the following advantages.

1. Its components are simple, with assembling and disassembling being convenient.

2. The property of easy assembling and disassembling can save the dimensions for package and a storing space, convenient for transportation.

3. The components are easily replaceable.

4. The bearing included in the connector can reduce mutual friction between the components during swinging action, thus permitting smooth swinging.

5. Its components can have a long service life because of reduced mutual friction between them.

While the preferred embodiment of the invention has been described above, it will be recognized and understood that various modifications may be made thereto and the appended claims are intended to cover all such modifications which may fall within the spirit and scope of the invention.

What is claimed is:

1. A connector for a swing assembly including a frame rod and a swing arm, the connector comprising:

a connecting member having a square horizontal hollow portion for receiving said frame rod therethrough, and two spaced vertical parallel flat ears extending down from said square hollow portion and each flat ear having a center hole formed therethrough;

two protective covers, each cover having an upper round portion with a center cavity and a center lateral hole formed therethrough and a vertical rectangular lower portion extending down from said round portion and having two lateral screw holes;

a bearing with a center shaft hole, the bearing being contained in a cavity defined by the central cavities of said two round portions of said two protective covers, said two protective covers with said bearing sandwiched therein being fitted in the space between said two vertical parallel flat ears of said connecting member, wherein said center lateral holes of said two round portions, said center holes of said two ears and said shaft hole of said bearing all aligned and a pivot pin extending through said aligned holes to secure said bearing and said two protective covers with said connecting member, with said bearing and said two protective covers being swingable relative to said connecting member; and, said rectangular lower portions of said protective covers of said connector being adapted to be secured to an end of a swing arm to permit said swing arm to swing relative to said frame rod.

* * * * *